US005223904A

United States Patent [19]

Umezawa

[11] Patent Number: 5,223,904

[45] Date of Patent: Jun. 29, 1993

[54] DEVICE AND APPARATUS FOR DETECTING THE SIZE OF AN ORIGINAL PLACE ON AN IMAGE-FORMING DEVICE

[75] Inventor: Noriyuki Umezawa, Yokohama, Japan

[73] Assignee: Kabushiki Kaisha Toshiba, Kawasaki, Japan

[21] Appl. No.: 776,614

[22] Filed: Oct. 15, 1991

[30] Foreign Application Priority Data

Oct. 19, 1990 [JP] Japan ..... 2-282545

[51] Int. Cl.[5] ..... G03G 15/00

[52] U.S. Cl. ..... 355/311; 355/68; 355/75; 355/233

[58] Field of Search ..... 355/311, 308, 309, 243, 355/233, 75, 68, 51; 271/3.1, 265, 227, 109, 171

[56] References Cited

U.S. PATENT DOCUMENTS 3,630,620 12/1971 Fackler ..... 355/76
4,456,372 6/1984 Yamauchi ..... 355/75
4,470,695 9/1984 Holzhauser et al. ..... 355/75
4,817,933 4/1989 Honjo et al. ..... 271/3.1
4,922,350 5/1990 Rombola et al. ..... 358/488
4,963,934 10/1990 Nezu ..... 355/235
4,978,992 12/1990 Kusumoto et al. ..... 355/75 X

*Primary Examiner*—A. T. Grimley
*Assistant Examiner*—T. A. Dang
*Attorney, Agent, or Firm*—Limbach & Limbach

[57] ABSTRACT

An image-forming apparatus has a first sensor for sensing whether or not an original is placed on an original table, a second sensor for sensing the size of the original placed on the original table, and a setting key for selectively setting an original size detection mode in which the second sensor is allowed to perform original size detection. When the first sensor senses the presence of the original in the original size detection mode set by the setting key, the second sensor is made to start the original size detection.

27 Claims, 11 Drawing Sheets

| SIZE OF ORIGINAL \ DETECTOR \ DETECTION POSITION | T | | U | | V | | W | | X | | Y | | Z | |
|---|---|---|---|---|---|---|---|---|---|---|---|---|---|---|
| | 60b | 60a | 60b | 60a | 60b | 60a | 60b | 60a | 60b | 60a | 60b | 60a | 60b | 60a |
| A3 | ○ | ○ | ○ | ○ | ○ | ○ | ○ | ○ | ○ | ○ | ○ | ○ | ○ | ○ |
| B4 | ○ | ○ | ○ | ○ | ○ | ○ | ○ | ○ | ○ | ○ | ○ | ○ | × | × |
| WIDTHWISE PLACEMENT OF A4 | × | ○ | × | ○ | × | ○ | × | ○ | × | ○ | × | × | × | × |
| WIDTHWISE PLACEMENT OF B5 | × | ○ | × | ○ | × | ○ | × | ○ | × | × | × | × | × | × |
| LENGTHWISE PLACEMENT OF A4 | ○ | ○ | ○ | ○ | ○ | ○ | × | × | × | × | × | × | × | × |
| LENGTHWISE PLACEMENT OF B5 | ○ | ○ | ○ | ○ | × | × | × | × | × | × | × | × | × | × |
| WIDTHWISE PLACEMENT OF A5 | × | ○ | × | ○ | × | ○ | × | × | × | × | × | × | × | × |
| LENGTHWISE PLACEMENT OF A5 | × | ○ | × | × | × | × | × | × | × | × | × | × | × | × |

FIG. 8

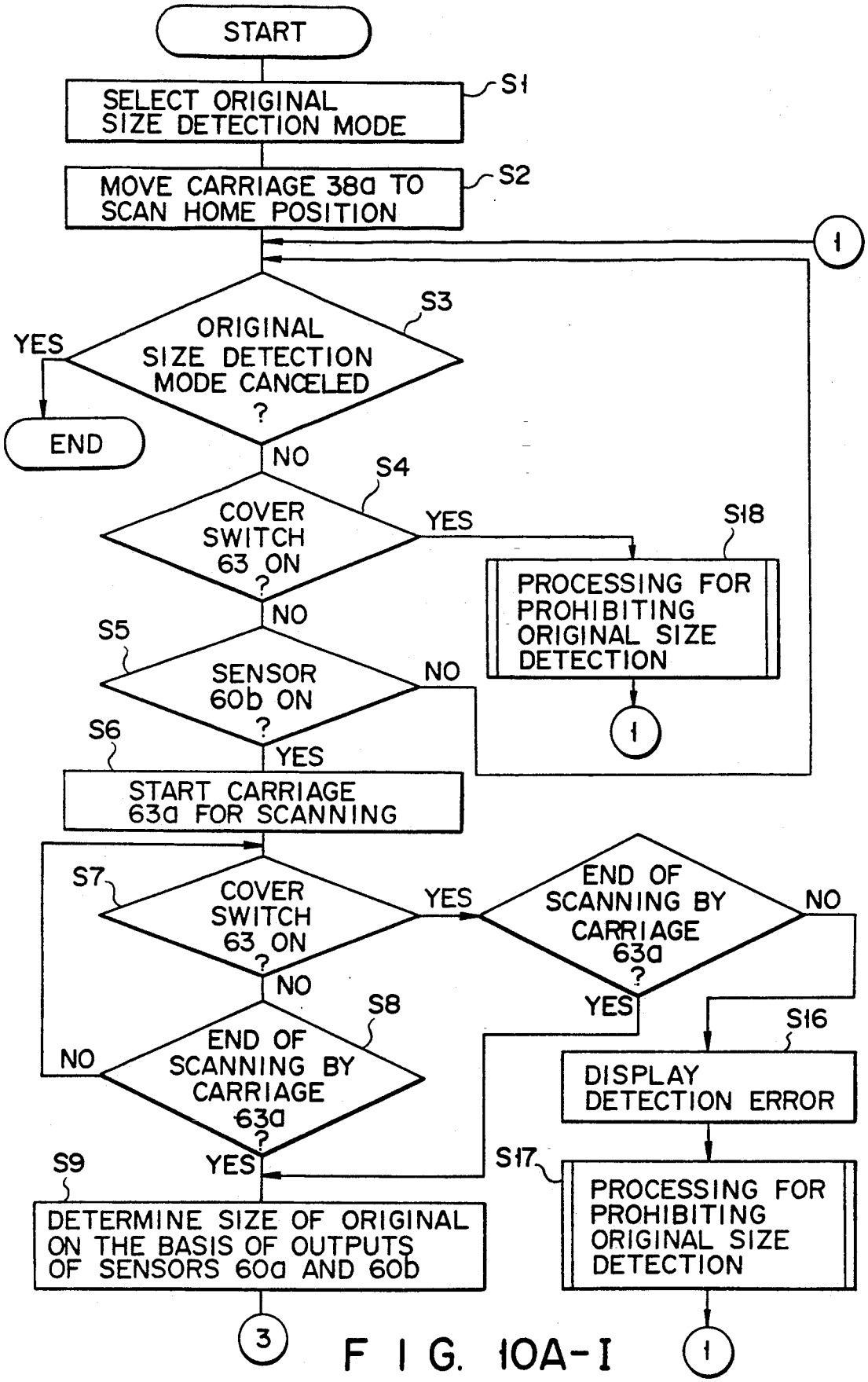
F I G. 10A-I

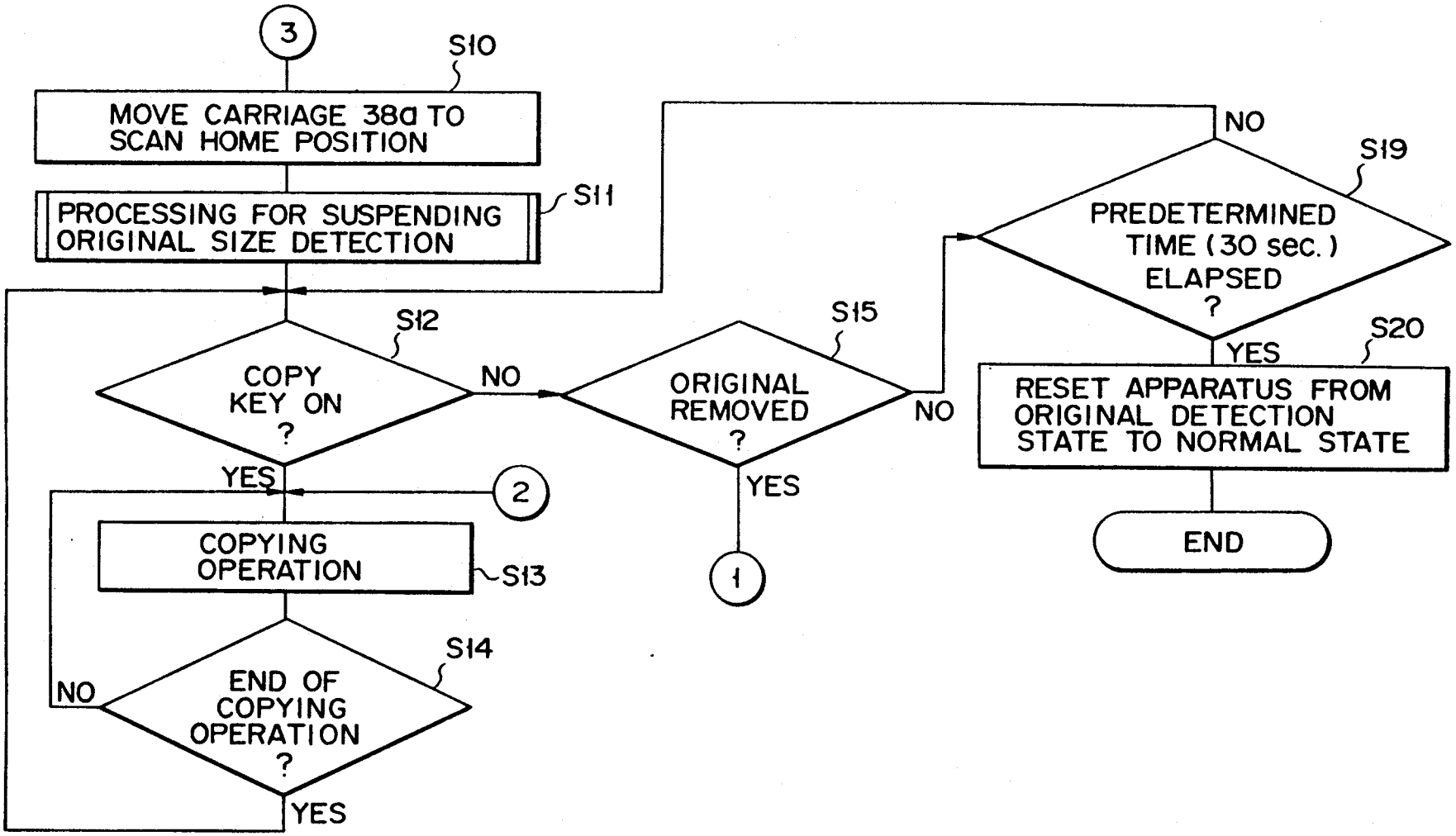
FIG. 10A-II

DEVICE AND APPARATUS FOR DETECTING THE SIZE OF AN ORIGINAL PLACE ON AN IMAGE-FORMING DEVICE

BACKGROUND OF THE INVENTION

1. Field of the Invention

The present invention relates to an image-forming apparatus which automatically detects the size of an original when the original is placed on an original table, and thereafter starts an image-forming process.

2. Description of the Related Art

In an image-forming apparatus, such as an electrophotographic apparatus, a size-detecting device is employed which detects the size of an original placed on an original table before the execution of a copying operation. The size-detecting device selects the sheets to be used for the copying operation or determines whether the size of the selected sheets is appropriate to the copying operation.

U.S. Pat. No. 4,963,934 discloses the size-detecting device to detect the size of an original, wherein the original table on which the original is placed is covered with a platen sheet, and the amount of light reflected by the original and the amount of light reflected by the platen sheet are sensed by sensors of the size-detecting device. The original and the platen sheet are discriminated from each other in accordance with the difference between the two amounts of light, and the size of the original is detected on the basis of the discrimination. Thereafter, the copying operation is started. As is understood from this, the original table on which the original is placed is first covered with the platen sheet, for the detection of the size of the original. Therefore, it takes time to finish the copying operation in the case where the size of the original has to be detected by the size-detecting device.

Moreover, there are many restrictions in determining a photosensitive material, the color of the platen sheet, the color of a light-emitting element, etc. For example, the platen sheet has to be colored for discriminating it from the original, and the color of the platen sheet has to be sensed with high sensitivity by the photosensitive member so as not to adversely affect the image produced in the copying operation. In addition, the light-emitting element must have a wavelength band in which the reflectance relative to the color of the platen sheet is low. In the case where an organic photoconductor is used as the photosensitive member, it is desirable that the color of the platen sheet be yellow, so as to ensure reliable image formation. It is also desirable that the color of the light-emitting element be blue since the blue color has low reflectance relative to the yellow color of the platen sheet. However, it is not easy to obtain a light-emitting diode which emits blue light, so that structural components are inevitably expensive, resulting in an increase in the manufacturing cost of the image-forming apparatus. As has been described, there have been both technical problems and cost problems in determining the photosensitive material, the color of the platen sheet, and the color of the light-emitting element.

According to a conventional image-forming apparatus, an original is placed on the original table in an original size detection mode, and the original size-detecting operation is started in synchronism with a copy start signal which is input by turning on the copy key of the apparatus. The light reflection type sensor stands by, together with an exposure device, at the predetermined reference position corresponding to the position of the rear end of a sheet of e.g. the A4 size. If the original placed on the original table is smaller than the A4 size, the sensor moves to the scan home position together with the exposure device when the copy key is turned on, and senses the rear end of the original during the movement. On the other hand, if the original is larger than the A4 size, the sensor moves away from the scan home position together with the exposure device so as to sense the rear end of the original. After the rear end of the original is sensed, the sensor and the exposure device move to the scan home position, and thereafter the copying operation is started.

As is understood from the above, if the size of an original is larger than a standard size (e.g., the A4 size), it requires a long time to produce the first copy in comparison with an ordinary copying operation which does not use the original size detection mode. Since the operator has to wait for a long time before the first copy is produced, the copying operation cannot be performed in a short time and with high efficiency.

SUMMARY OF THE INVENTION

Accordingly, an object of the present invention is to provide an image-forming apparatus which eliminates the above problems and which is capable of producing copies in a short time even when the original size detection mode is selected.

Another object of the present invention is to provide an image-forming apparatus wherein the photosensitive material, the color of the platen sheet, the color of the light-emitting element, etc. can be determined without any restriction.

A further object of the present invention is to provide an image-forming apparatus which is capable of producing the first copy of an original in a short time eve if the original is of a large size and which therefore ensures an efficient copying operation.

To achieve these objects, the present invention provides an image forming apparatus, comprising: an original table on which an original having an original image is placed; first sensor means for detecting the size of the original placed on the original table; second sensor means for detecting the time when the original is placed on the original table; means for activating the first sensor means in response to the second sensor means; and means for forming an image corresponding to the original image on an image bearing member according to the size detected by the first sensor means.

According to the image-forming apparatus of the present invention, the original size detection is executed prior to the start of the copying operation. Therefore, the copying time needed when the original size detection mode is selected is as long as the time required for the first copy of the original to be produced when the original size detection mode is not selected. Since the time the operator has to wait for is shortened in the original size detection mode as well, the efficiency of the copying operation can be improved. Moreover, since both the color of the original and that of the platen sheet are identified at the time of original size detection, it is not necessary to color the platen sheet in accordance with the sensitivity of the photosensitive member, nor is it necessary to determine the color of the light emitted by the sensor means. Therefore, the determination of the material of the photosensitive member is not restricted at the time of design; an arbitrary photosensitive material can be used without increasing the manufacturing cost of the entire apparatus.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 1 through 10 illustrate one embodiment of the present invention, of which:

FIG. 1 is a schematic explanatory view of the entire image-forming apparatus;

FIG. 2 is a plan view of a control panel;

FIG. 3 is a schematic perspective view of an exposure device;

FIG. 4 is a schematic explanatory view showing how first and second sensors are provided;

FIG. 5 is a schematic explanatory view showing how an original cover is moved;

FIG. 6 is a explanatory view of the detections positions on an original table;

FIG. 7 is a schematic block diagram of a control system;

FIG. 8 is an explanatory view logically showing the identification data stored in a ROM;

FIGS. 10A-I and 10A-II are flowcharts showing how the image-forming apparatus performs original size detection; and FIG. 10B is a flowchart showing how the image-forming apparatus performs the processing for prohibiting or suspending the original size detection.

DETAILED DESCRIPTION OF THE PREFERRED EMBODIMENTS

One embodiment of the present invention will now be described, with reference to FIGS. 1 through 10.

Figure 1:
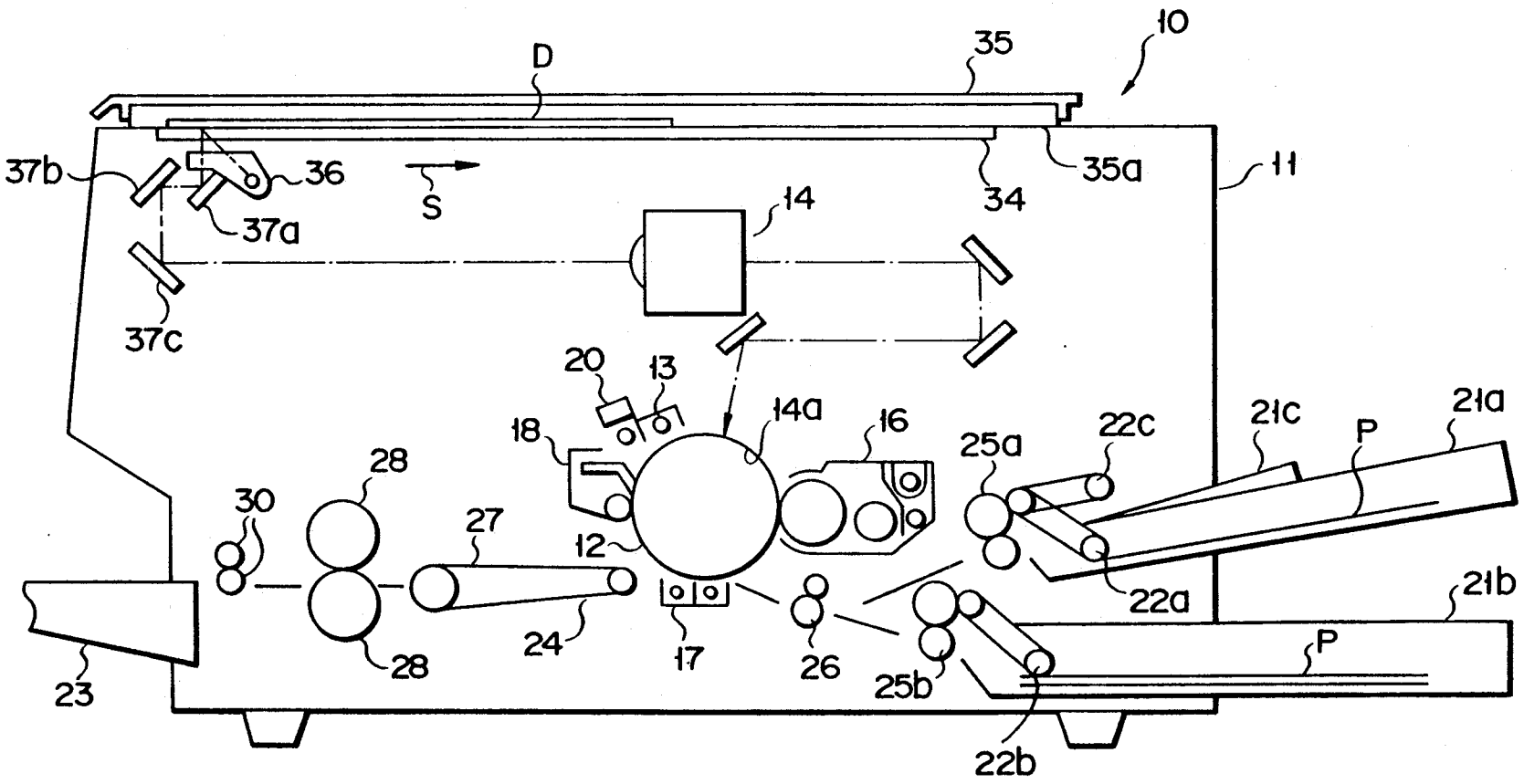

FIG. 1 is a schematic explanatory view of an image-forming apparatus 10. The casing 11 of the apparatus 10 contains a photosensitive drum 12 substantially in the center of the interior thereof. Around the photosensitive drum 12, a charging device 13, a developing device 16, a transfer/peeling charger 17, a cleaning device 18 and a charge-removing lamp 20 are arranged in the order mentioned. The exposure position 14*a* of an optical device 14 is located between the charging device 13 and the developing device 16. Cassettes 21*a* and 21*b* containing sheets P and manual insertion table 21*c* (through which sheets are manually inserted) are located on the right side of the casing 11. Inside the casing 11, a sheet path 24 is defined along which a sheet P picked up from cassette 21*a* or 21*b* or manual insertion table 21*c* by means of pick-up roller 22*a*, 22*b* or 22*c* is conveyed to the photosensitive drum 12 and is then discharged onto a sheet discharge tray 23 located on the left side of the casing 11. In that region of the sheet path 24 which is upstream of the photosensitive drum 12 (i.e., the right side of the casing 11 depicted in FIG. 1), first and second pairs of separation rollers 25*a* and 25*b* and a pair of register rollers 26 are arranged. In that region of the sheet path 24 which is downstream of the photosensitive drum 12 (i.e., the left side of the casing 11 depicted in FIG. 1), a conveyor belt 27, a pair of fixing rollers 28 and a pair of discharge rollers 30 are arranged. An original table 34 on which an original D is placed, and an original cover 35 with which to cover the original table 34 are located on top of the casing 11. The original cover 35 is provided with a white platen sheet 35*a*.

Figure 2:
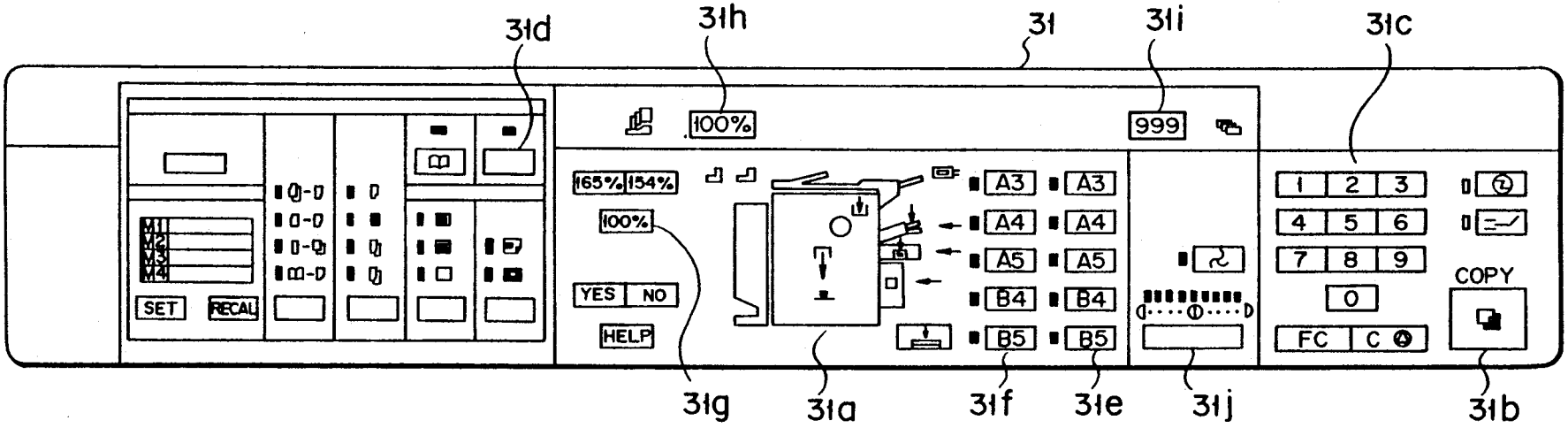

FIG. 2 shows a control panel 31 located on the front wall of the casing 11. On the control panel 31, the following are arranged: a display panel 31*a* for schematically indicating where in the apparatus 10 an error occur; a copy key 31*b* for commanding the start of a copying operation; a ten key pad 31*c* for entering the number of copies to be produced; a mode selection key 31*d* for selectively setting an original size detection mode in which original size detection is performed by first and second sensors 60*a* and 60*b* (which will be mentioned later); a sheet size-designating section 31*e*; an original size-designating section 31*f*; a magnification-designating section 31*g* for designating the size of an original when the apparatus is not in the original size detection mode; a magnification indicator 31*h*; a copy number indicator 31*i* for indicating the number of copies to be produced; a density-setting section 31*j*; etc.

Figure 3:
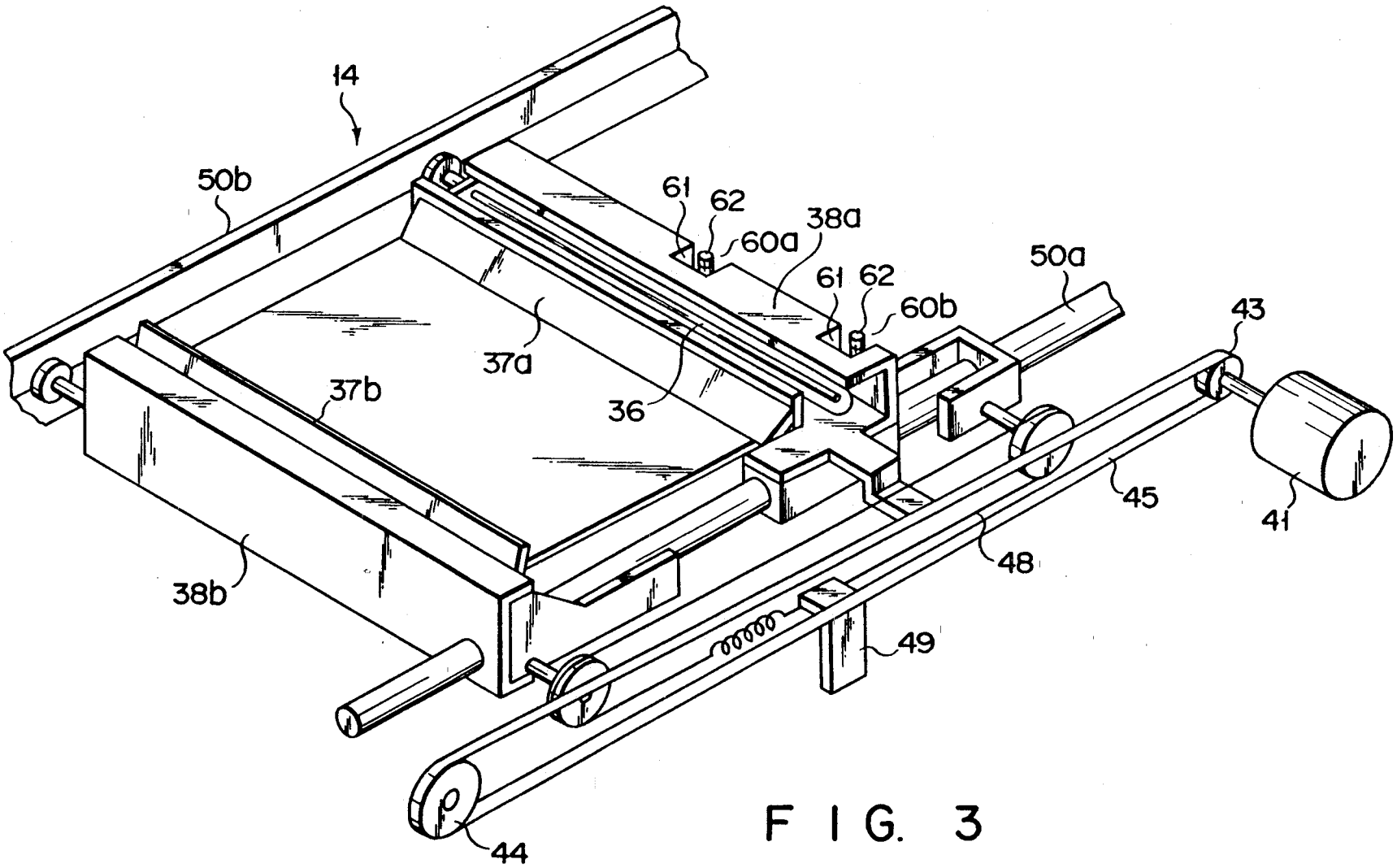

FIG. 3 shows an optical device 14. The optical device comprises a first carriage 38*a* and a second carriage 38*b*. An exposure lamp 36 and a first mirror 37*a* are mounted on the first carriage 38*a*. A first sensor 60*a* and second sensor 60*b* are also mounted on the first carriage 38*a*. The first sensor 60*a* detects the size of the original D when the apparatus is in the original size detection mode. The second sensor 60*b* detects the time when the original is placed on the original placed on the original table and also detects the size of an original D with the first sensor 60*a* when the apparatus is in the original size detection mode. According to the image-forming apparatus, the size of the original D is detected, with the original cover 35 unfolded. Therefore, each of the first and second sensors 60*a* and 60*b* is made by a light modulation type reflection sensor, which comprises a light-emitting element 61 for emitting pulse-modulated light and a light-receiving element 62 which receives only the pulse-modulated light emitted from the pulse light-emitting element 61.

A second mirror 37*b* and a third mirror 37*c* are mounted on the second carriage 38*b*. The first and second carriages 38*a* and 38*b* are movable along a guide shaft 50*a* and a guide rail 50*b*. The first and second carriages 38*a* and 38*b* are driven by a scanning motor 41 made by a pulse motor. By means of the mechanism including a driving belt 45, a wire-fixing portion 49 and a wire 48, the first and second carriages 38*a* and 38*b* are moved backward and forward such that the moving speed of the first carriage 38*a* and that of the second carriage 38*b* are 2:1. The driving belt 45 is stretched between, and would around first and second pulleys 43 and 44.

Figure 4:
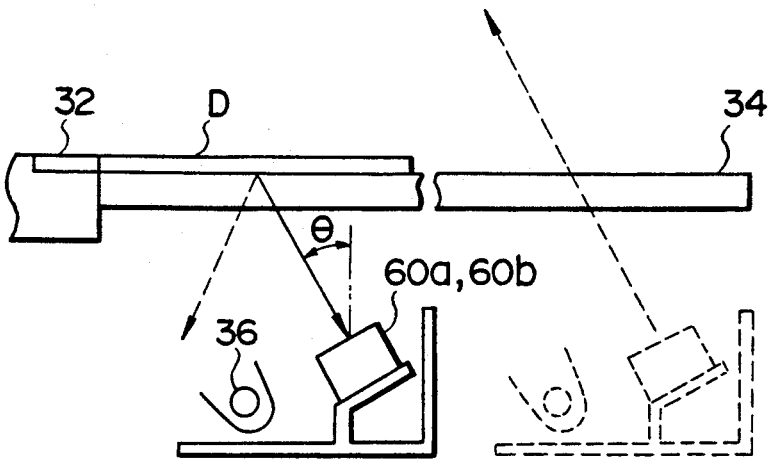

As is shown in FIG. 4, the first and second sensors 60*a* and 60*b* are inclined by a predetermined angle $\theta$ with reference to the vertical direction of the original table 34. With this structure, a detection error which may be caused by the regular reflection of the original table 34 is prevented.

Figure 5:
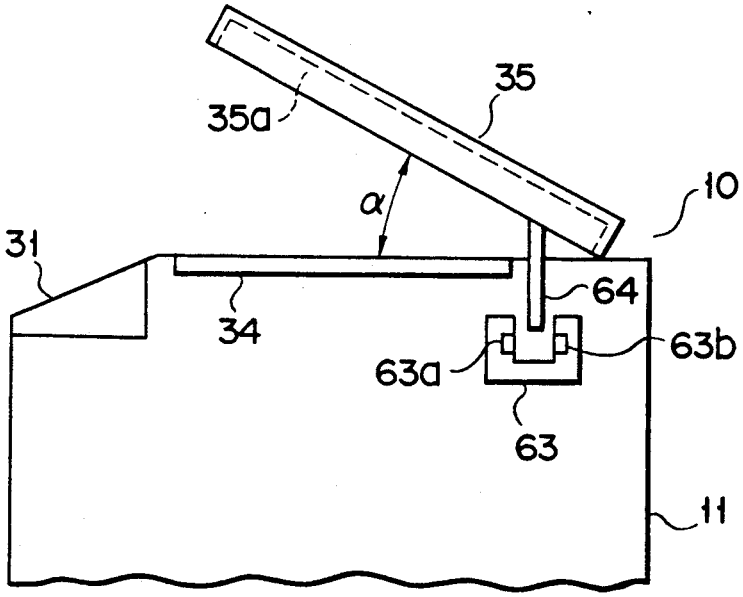

A cover switch 63 is located on the rear side of the original table 34. As is shown in FIG. 5, the cover switch 63 is a photo-interruption type comprising a light-emitting element 63*a* and a light-receiving element 63*b*, and senses the presence or absence of an actuator 64 which is swung in association with the folding or unfolding movement of the original cover 35. When the angle between the original cover 35 and the original table 34 becomes narrower than a predetermined angle $\alpha$, the actuator 64 turns on the cover switch 63, thus preventing the first and second sensors 60*a* and 60*b* from detecting the size of an original D. The angle $\alpha$ is determined in accordance with the focal lengths of the first and second sensors 60*a* and 60*b*, such that the first and second sensors 60*a* and 60*b* are not too sensitive to the light reflected by the platen sheet 35*a*. With the angle $\alpha$ determined in this matter, the light reflected by the platen sheet 35*a* is discriminated from the light reflected by the original at the time of sensing.

Figure 6:
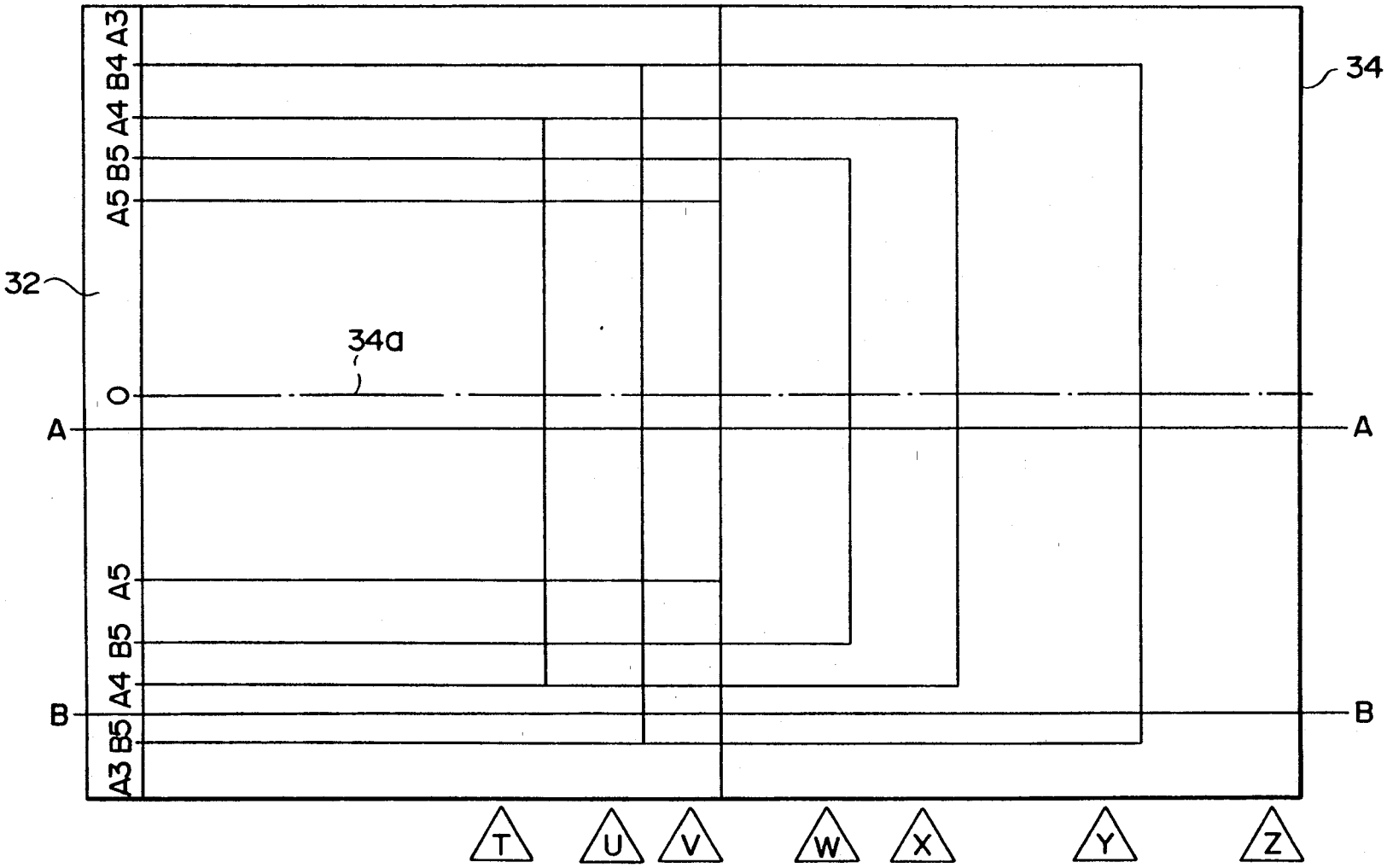

FIG. 6 shows an original scale 32 located at that edge of the original table 34 which corresponds to the front end of an original D. The original scale 32 serves to guide the original D when the original is placed on the original table 34. In FIG. 6, line A—A and line B—B indicate the scanning lines of the first and second sensors 60*a* and 60*b*, respectively, which are mounted on the first carriage 38*a*. The original table 34 has such an area that an original D whose size is in the range of A5 to A3 can be placed. The original D is placed on the original table 34 such that the center line of the original D coincides with the center line 34*a* of the original table 34, irrespective of the size of the original D. The center line of the original table 34 is indicated on the original scale 32.

In FIG. 6, "T", "U", "V", "W", "X", "Y" and "Z" each indicates a sensing position at which the first carriage 38*a* is located at the time of sensing the size of an original. At the sensing positions "T", "U", "V", "W", "X", "Y" and "Z", the first and second sensors 60*a* and 60*b* produce sensing signals, and the output levels of the sensing signals are checked by a control device 70 shown in FIG. 7.

Figure 7:
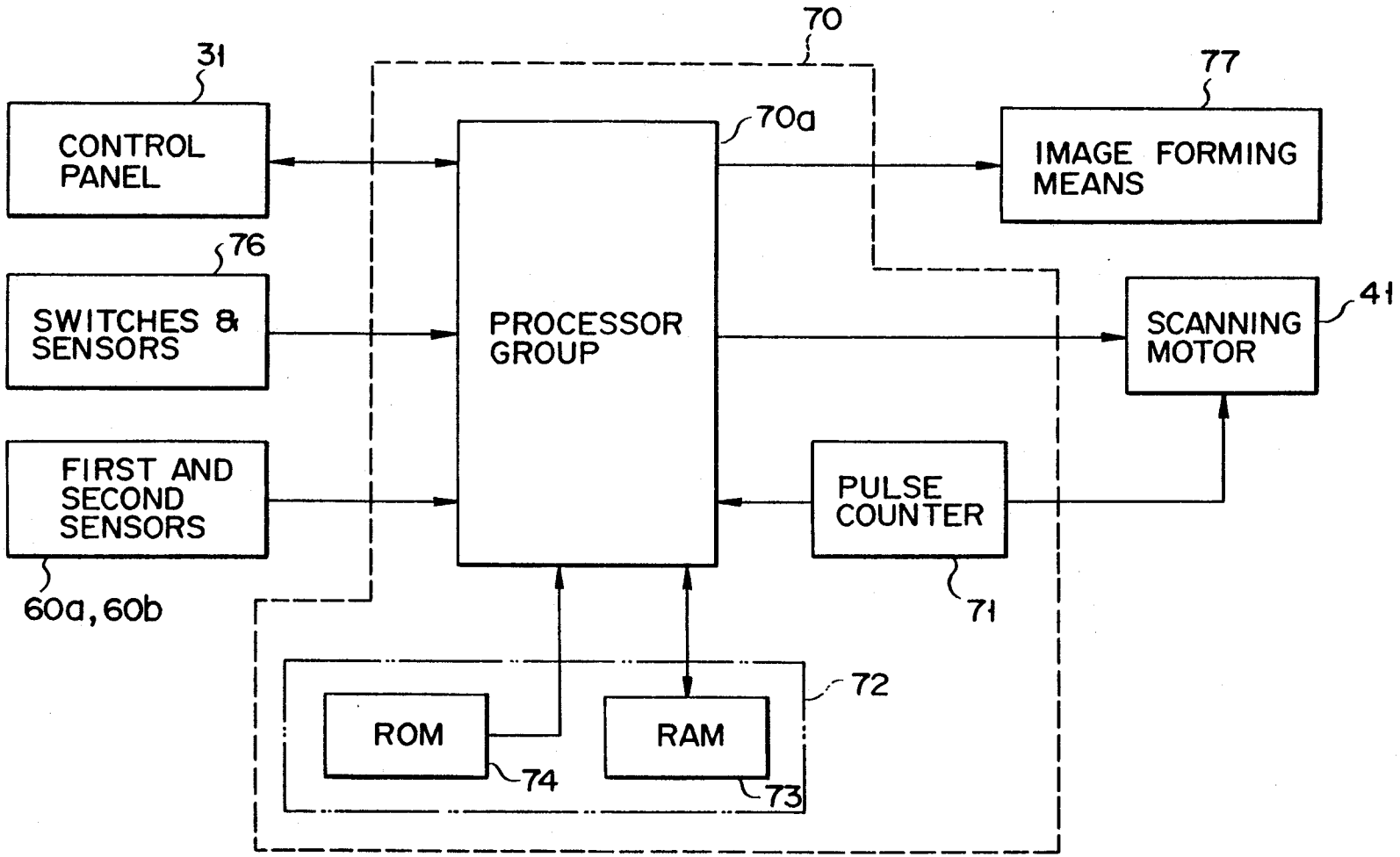
Figure 9A:
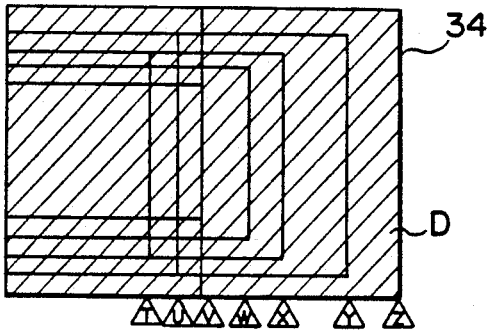
FIGS. 9A–9H show how originals of various sizes are placed on the original table, FIG. 9A corresponding to the case where an original of A3 size is placed, FIG. 9B to the case where an original of B4 size is placed, FIG. 9C to the case where an original of A4 size is placed widthwise, FIG. 9D to the case where an original of B5 size is placed widthwise, FIG. 9E to the case where an original of A4 size is placed lengthwise, FIG. 9F to the case where an original of B5 size is placed lengthwise, FIG. 9G to the case where an original of A5 size is placed widthwise, and FIG. 9H to the case where an original of A5 size is placed lengthwise.
Figure 9E:
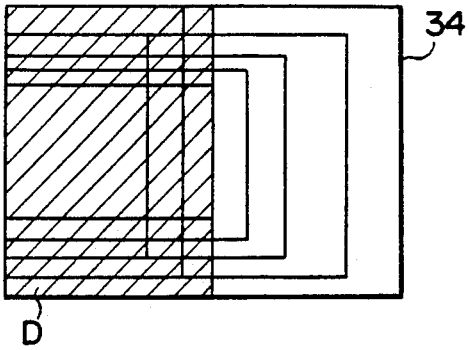
Figure 9B:
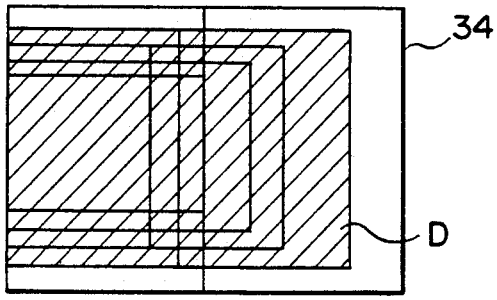
Figure 9F:
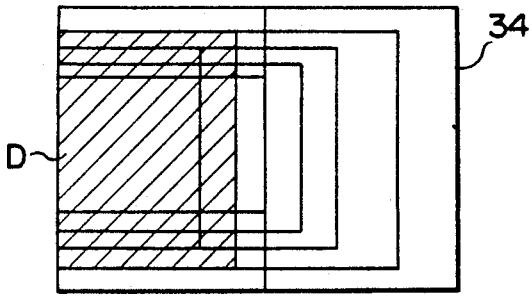
Figure 9C:
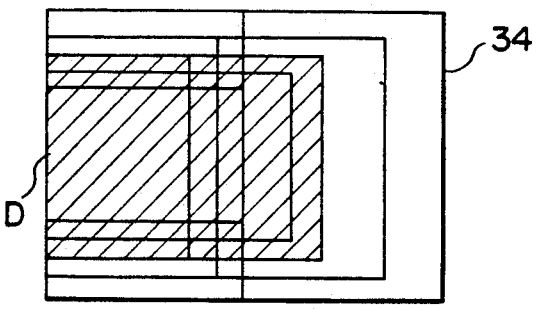
Figure 9G:
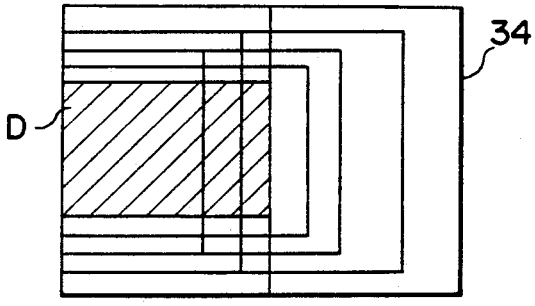
Figure 9D:
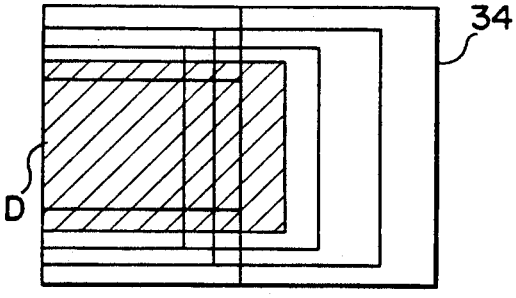
Figure 9H:
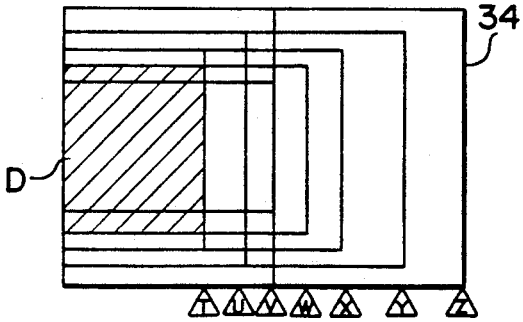

As is shown in FIG. 7, the control device 70 comprises a processor group 70*a* (i.e., a group of processors). The processor group 70*a* receives signals supplied from the keys on the control panel 31, a sheet size detection switch (not shown), the cover switch 63, and various switches/sensors 76 (which include a toner density sensor, for example). The processor group 70*a* also receives electric signals supplied from the first and second sensors 60*a* and 60*b* (i.e., the electric signals obtained by conversion of the optical signals which are detected by the light-receiving elements 62 and which represent the light reflected by an original D). Further, the processor group 70*a* controls image-forming means 77 (which comprises the photosensitive drum 12, and the charging and developing devices 13 and 16 arranged around the drum 12, etc.), and controls the scanning motor 41 by means of a pulse counter 71. Moreover, the processor group 70*a* determines the size of an original D on the basis of the signals supplied from the first and second sensors 60*a* and 60*b*. Specifically, a memory 72 which stores various kinds of data used for the determination of the size of an original D is connected to the processor group 70*a*. The memory 72 is made up of a RAM (random access memory) 73 and a ROM (read-only memory) 74. RAM 73 stores data on the detecting positions, i.e., the positions of the first carriage 38*a*, in relation to the counts of the pulse counter 71, while ROM 74 stores identification data used for determining the size of an original D in accordance with combinations between the detecting position and the output levels of the first and second sensors 60*a* and 60*b*.

From the pulse counter 71, the processor group 70*a* receives the data indicating the number of pulses supplied to the scanning motor 41. On the basis of this data and the related detecting position data stored in RAM 73, the processor group 71 determines the position of the first carriage 38*a*. Further, the processor group 70*a* checks the output levels of the detecting signals which the first and second sensors 60*a* and 60*b* produce at the detecting positions "T", "U", "V", "W", "X", "Y" and "Z". In consideration of these pieces of data and the identification data stored in ROM 74, the processor group 70*a* determines the size of an original D.

FIG. 8 logically shows the identification data stored in ROM 74. The processor group 70*a* determines the size of an original D in accordance with the detecting position of the first carriage 38*a* and the output levels of the detecting signals which the first and second sensors 60*a* and 60*b* produce at the detecting position. In FIG. 8, the output level of the first sensor 60*a* (which moves along line A—A in FIG. 6) and the output level of the second sensor 60*b* (which moves along line B—B in FIG. 6) are indicated by either ∘ or ×. Symbol ∘ represents the state where the light-receiving element 62 receives the light reflected by the original D (i.e., the state where the original D is sensed), while symbol × represents the state where the light-receiving element 62 does not receive the light reflected by the original D (i.e., the state where the original D is smaller than the size corresponding to the detecting position).

A description will be given of the operation of the image-forming apparatus mentioned above.

At ordinary times, the image-forming apparatus is set in the non-detection mode wherein the size of an original D is not detected by the sensors 60*a* and 60*b*, and the first carriage 38*a* stands by at the reference position corresponding to the position of the rear end of A4 size. Where the detection of the size of the original D is not necessary, the operator turns on the copy key 31*b* immediately after placing the original D on the original table 34, so as to produce a copy of the original D.

Where the detection of the size of the original D is necessary, the image-forming apparatus is operated according to the flowcharts shown in FIGS. 10A-1 and 10A-II. That is, the operator turns on the mode selection key 31*d* of the control panel 31. Then, an original size detection mode signal is supplied to the processor group 70*a*. As a result, the processor group 70*a* selects the original size detection mode wherein the size of the original D is detected by the sensors 60*a* and 60*b*, as shown in step S1. Upon selection of the original size detection mode, the processor group 70*a* actuates the scanning motor 41, so that the first carriage 38*a* is moved from the reference position to the scan home position close to the original scale 32, and the first and second sensors 60*a* and 60*b* are made to stand by and wait for the original size detection (see step S2). It should be noted that the cover switch 63 is ON at the time. Therefore, the first and second sensors 60*a* and 60*b* cannot start the original size detection.

Thereafter, when the original size detection is not cancelled (step S3), the operator opens the original cover 35, so as to place the original D on the original table 34. Thus, the actuator 64 is raised, turning off the cover switch 63, so that the first and second sensors 60*a* and 60*b* are allowed to start the original size detection (step S4). That is, the second sensor 60*b* detects the time when the original is placed, and the first and second sensors 60*a* and 60*b* detects the size of the original D. If the original D placed along the scale on the original table 34 is of A3 size, the light-receiving elements 62 detects the original D placed on the original table by receiving the light which is emitted by the light-emitting elements 61 and reflected by the original D (step S5). When a signal indicating the time when the original D is supplied from the second sensor 60*b* to the processor group 70*a*, the processor group drives the scanning motor 41 at once, and the first carriage 38*a* starts a scanning operation in the direction indicated by arrow S in FIG. 1, so as to sense the size of the original D (step S6).

During the scanning operation by the first carriage, when detecting that the cover switch 63 is not ON (step S7) and that the first carriage 38*a* completes a scanning operation (step S8), the processor group 70*a* checks the output levels of the signals which the first and second sensors 60*a* and 60*b* produce at the detecting positions "T" through "Z" (step S9). In the case of A3 size, the original D is detected at all detecting positions "T" to "Z", as is understood from FIG. 9A. The original D is detected at all detecting positions only when its size is A3 as is shown in FIG. 8. Accordingly, the processor group 70*a* determines that the original D is of A3 size. FIGS. 9B–9H show how originals D of various sizes are placed on the original table 34, and the areas occupied by the originals D are indicated by the oblique liens. If, as in the case shown in FIG. 9B, the first and second sensors 60*a* and 60*b* do not detect an original D at detecting position "Z" and detect it at the other detecting positions, then the processor group 70*a* determines that the original is of B4 size, with reference to the identification data shown in FIG. 8. Likewise, the cases shown in FIGS. 9C–9H are determined as corresponding to the "widthwise placement of A4", "lengthwise placement of B5", "lengthwise placement of A4", "lengthwise placement of B5", "widthwise placement of A5", and "lengthwise placement of A5", respectively.

After the original size detection mentioned above, the first carriage 38*a* is moved to the scan home position (step S10) and a cassette containing the appropriate-size sheets P is selected in accordance with the original size detected and the image magnification entered, the processing for it is suspended (i.e., temporarily stopped) as show in step S11.

Then, the operator closes the original cover 35, and enters data on the image formation conditions, such as the number of copies to be produced and the image magnification and density of the copies, by operating the control panel 31. Thereafter, the operator turns on the copy key 31*b* (step S12). Accordingly, the copying operation is started (step 13).

More specifically, the photosensitive drum 12 begins to rotate, and charging, exposure and development steps are executed in accordance with the rotation, so as to form a toner image on the photosensitive drum 12. The toner image on the photosensitive drum 12 is conveyed to the position facing the transfer/peeling charger 17. In synchronism with these operations, a sheet P is picked up from one of the cassettes 21*a* and 21*b*, and is fed to the transfer/peeling charger 17 by the register rollers 26 such that the leading end of the sheet P aligns with the start of the toner image formed on the photosensitive drum 12. After the toner image is transferred from the photosensitive drum 12 to the sheet P, the sheet P is peeled (or separated) from the photosensitive drum 12. After the toner image is fixed to the sheet P by means of the fixing rollers 28, the sheet P is discharged onto the sheet discharge tray 23 by means of discharge rollers 30, thereby completing image formation.

After the transfer of the toner image, the photosensitive body 12 is cleared of the toner remaining thereon by the cleaning device 18, and set in the state ready for the next copying operation by the charge-removing lamp 20.

The above operations are repeated until a copy is produced by the number of times set by the operator. In the meantime, the original size detection is prohibited, and the execution of only the copying operation is allowed.

After a necessary number of copies of the original D are produced (step 14), the operator removes the original D from the original table 34, and places another original D thereon. If the removal of the original is detected (step S15) and the original size detection mode is ON at the time, the copying operation for the second original D is performed after the original size detection is executed in a similar manner to that mentioned above (steps S3 to S14).

After copies of all originals D are produced, the operator turns off the mode selection key 31*d*, to thereby set the apparatus in the non-detection mode of the original size. Accordingly, the first carriage 38*a* is made to stand by at the reference position corresponding to the position of the rear end of A4 size, and waits for the next copying operation to be started.

If, during the execution of the original size detection in the original size detection mode, the original cover 35 is closed and its angle relative to the original table 34 becomes narrower than the angle $\alpha$, the cover switch 63 is turned on. Therefore, the processor group 70*a* determines that the original size detection cannot be continued. Hence, a mark indicating the size detection error is displayed on the display panel 31*a* (step S16) and the apparatus is set in a state where original size detection is prohibited (step S17).

If the cover switch 63 is turned on (step S4) in the state where original size detection mode remains uncanceled (step S3), the apparatus is set in the state where original size detection is prohibited (step S18).

If the original is kept unremoved from the original table 34 more than a predetermined time (e.g., 30 seconds) without the copy key 31*b* being turned on (steps S13→S14→S19), the apparatus is reset into a normal operation state, in which a copying operation is executed.

Figure 10B:
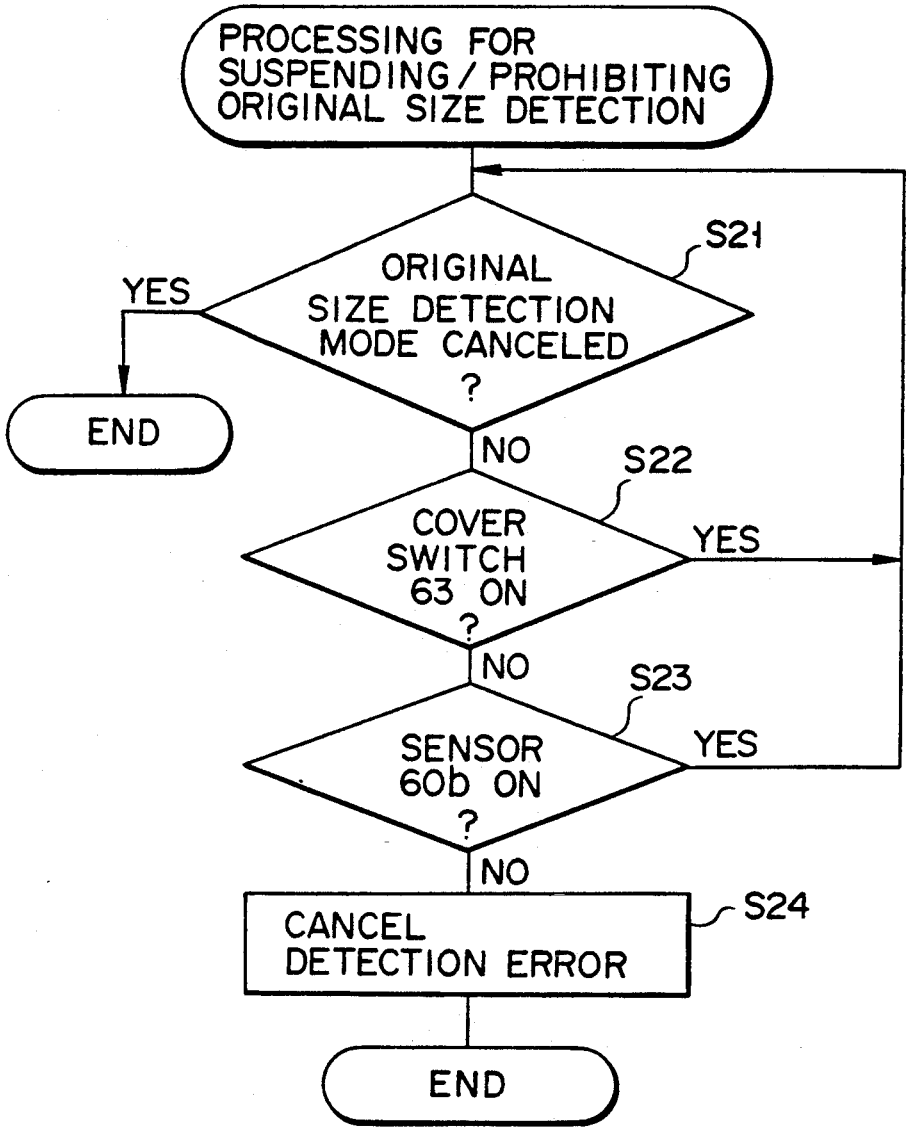

As is shown in FIG. 10B, in the state where the original size detection is prohibited or suspended, a detection error is canceled (step S24) only when it is determined that the original detection mode remains uncanceled (step S21), that the cover switch 63 is not ON (step S22), and that the sensor 60*b* is not ON (step S23).

According to the embodiment mentioned above, the operator is only required to place an original D on the original table 34 in the original size detection mode of the apparatus. With the original D on the original table 34 being sensed, the operation for detecting the size of the original D is automatically started. This size-detecting operation is completed when the operator starts the copying operation. In other words, even in the original size detection mode, the copying time needed to produce the first copy is the same as the corresponding copying time of the non-detection mode, without reference to the size of the original D. Since, therefore, the time of a copying operation requiring original size detection can be shortened, the operator does not have to wait for a long time, as in the case of a conventional apparatus. As a result, the efficiency of the copying operation can be improved.

In addition, the size detection operation is started as soon as the original D is placed on the original table 34; it is not delayed until the original table 34 is covered with the original cover 35. In the size detection, therefore, it is not necessary to discriminate the original D and the platen sheet 35*a* from each other, as in a conventional apparatus. Therefore, the color of the platen sheet 35*a* and the color of the light-emitting elements 61 of the sensors are in no way dependent on the characteristics of the photosensitive member. Thus, any desirable photosensitive material can be used, without increasing the manufacturing cost of the entire apparatus.

Moreover, the scan home position from which the size detection operation is started is located in the vicinity of the original scale 32. If the original D is placed away from the original scale 32, the second sensor 60*b* cannot detect the original D, so that the size of the original cannot be detected. Accordingly, a size detection error arising from the undesirable placement of the original D is reliably prevented, thus enhancing the reliability of the size detection.

The present invention is not limited to the above embodiment; it may be modified in various manners without departing from the spirit and scope thereof. For example, the first sensor means for sensing the presence or absence of an original and the second sensor means for sensing the size of the original may be provided independently of each other, if so desired. However, in order to reduce the number of structural components and to thereby decrease the manufacturing cost of the apparatus and make good use of the interior of the apparatus, it is desirable that the first and second sensor means be constituted by a single sensor, as in the foregoing embodiment.

In addition, the scan home position from which to start the original size detection may be arbitrarily determined. For example, the scan home position may be determined in such a manner as to correspond to the rear end of the smallest possible sheet. However, in order to prevent an error arising from undesirable placement of an original, it is preferable that the scan home position be located in the original scale, as in the foregoing embodiment.

Moreover, the functions of the control means are not limited to those described above. If an original document contains a large number of pages and data on the size of that original document is entered and stored in the memory, then data on the size of the first page of the original document may be stored in the RAM. By so doing, it is not necessary to execute the size detection operation, each time the second or succeeding pages of the original are placed on the original table.

What is claimed is:

1. An image forming apparatus comprising:

an original table on which an original having an original image is placed, the original having an unknown size;

a platen cover foldable on the original table, the platen cover having a folded position and an unfolded position;

first sensor means for detecting the size of the original placed on the original table when the platen cover is in the unfolded position;

second sensor means for detecting when the original is placed on the original table;

means for activating the first sensor means in response to the second sensor means; and means for forming an image corresponding to the original image on an image bearing member according to the size detected by the first sensor means.

2. An image-forming apparatus according to claim 1, wherein said first sensor means has first light emitting means for emitting light and first means for receiving light emitted from the first light-emitting means, and said second sensor means has second light emitting means for emitting light and second means for receiving light emitted from the second light-emitting means.

3. An image-forming apparatus according to claim 1, wherein the second light emitting means includes the first light emitting means, time detecting means for emitting light, the first means for receiving light, and means for receiving light emitted from the time detecting means.

4. An image-forming apparatus according to claim 1, further comprising an original scale on the original table for aligning the original, said second sensor means having a home position close to the original scale.

5. An image-forming apparatus according to claim 1, wherein said second sensor means serves also as means for detecting the original placed on the original table by scanning the original in a predetermined direction.

6. An image-forming apparatus according to claim 1, wherein the first sensor means and the second sensor means includes a light reflection type sensor having a light emitting element for emitting light and a light receiving element for receiving light emitted from the light-emitting element.

7. An image-forming apparatus according to claim 6, wherein the light reflection type sensors of each of the first sensor means and the second sensor means are inclined by a predetermined angle with reference to a vertical direction of the original table.

8. An image-forming apparatus according to claim 1, further comprising means for selecting an image bearing member having a size in accordance with the detected size of the original.

9. An image-forming apparatus to claim 1, further comprising means for selecting magnification for the image to be formed on the image bearing member, in accordance with the detected size of the original.

10. An image-forming apparatus, comprising:

an original table on which an original having an original image is placed, the original having an unknown size;

cover means, foldably disposed on the original table, for covering the original on the original table, the cover means having a folded and an unfolded condition;

first sensor means for detecting the size of the original placed on the original table when the cover means is in the unfolded condition;

second sensor means for detecting when the original is placed on the original table;

third sensor means for detecting that the cover means is in the folded condition;

means for activating the first sensor means in response to the second sensor means;

means for preventing the first sensor means from detecting the size of the original when the third sensor means detects the folded condition; and means for forming an image corresponding to the original image on a image bearing member and having the size of the original when the size of the original has been detected before the preventing means prevents the size of the original from being detected.

11. An image-forming apparatus according to claim 10, wherein the first sensor means has first light emitting means for emitting light and first means for receiving light emitted from the first light-emitting means, and the second sensor means has second light emitting means for emitting light and second means for receiving light emitted from the second light-emitting means.

12. An image-forming apparatus according to claim 10, wherein the second light emitting means includes the first light emitting means, time detecting means for emitting light, the first means for receiving light, and means for receiving light emitted from the time detecting means.

13. An image-forming apparatus according to claim 10, further comprising an original scale on the original table for aligning the original, said second sensor means having a home position close to the original scale.

14. An image-forming apparatus according to claim 10, wherein said second sensor means serves also as means for detecting the original placed on the original table by scanning the original in a predetermined direction.

15. An image-forming apparatus according to claim 10, wherein the first sensor means and the second sensor means includes a light reflection type sensor having a light emitting element for emitting light and a light receiving element for receiving light emitted from the light-emitting element.

16. An image-forming apparatus according to claim 15, wherein the light reflection type sensors of each of the first sensor means and the second sensor means are inclined by a predetermined angle with reference to a vertical direction of the original table.

17. An image-forming apparatus according to claim 10, further comprising means for selecting an image bearing member having a size in accordance with the detected size of the original.

18. An image-forming apparatus to claim 10, further comprising means for selecting magnification for the image to be formed on the image bearing member, in accordance with the detected size of the original.

19. An image-forming apparatus comprising:

an original table on which an original having an original image is placed, the original having an unknown size;

an original scale for positioning the original on the original table;

a platen cover foldable on the original table;

first sensor for detecting the size of the original on the original table;

second sensor means for detecting when the original is placed on the original table and detecting the size of the original on the original table with the first sensor;

a cover switch for detecting a folded condition that the covering means is folded on the original table;

means for selectively setting a normal image forming mode and a size detecting mode wherein the first sensor and the second sensor detect the size of the original;

means for moving the second sensor in a home position close to the original scale when the size detecting mode is set by the setting means;

means for activating the first sensor and the second sensor to detect the size of the original after the second sensor detects when the original has been placed on the original table in the size detecting mode;

means for preventing the first sensor and the second sensor from detecting the size of the original when the cover switch detects the folded condition in the size detecting mode; and means for forming an image corresponding to the original image on an image bearing member and having the size of the original when the size of the original has been detected before the preventing means prevents the size of the original from being detected.

20. An image-forming apparatus according to claim 19, wherein the first sensor means has first light emitting means for emitting light and first means for receiving light emitted from the first light-emitting means, and the second sensor means has second light emitting means for emitting light and second means for receiving light emitted from the second light-emitting means.

21. An image-forming apparatus according to claim 19, wherein the second light emitting means includes the first light emitting means, time detecting means for emitting light, the first means for receiving light, and means for receiving light emitted from the time detecting means.

22. An image-forming apparatus according to claim 19, further comprising an original scale on the original table for aligning the original, said second sensor means having a home position close to the original scale.

23. An image-forming apparatus according to claim 19, wherein said second sensor means serves also as means for detecting the original placed on the original table by scanning the original in a predetermined direction.

24. An image-forming apparatus according to claim 19, wherein the first sensor means and the second sensor means includes a light reflection type sensor having a light emitting element for emitting light and a light receiving element for receiving light emitted from the light-emitting element.

25. An image-forming apparatus according to claim 24, wherein the light reflection type sensors of each of the first sensor means and the second sensor means are inclined by a predetermined angle with reference to a vertical direction of the original table.

26. An image-forming apparatus according to claim 19, further comprising means for selecting an image bearing member having a size in accordance with the detected size of the original.

27. An image-forming apparatus to claim 19, further comprising means for selecting magnification for the image to be formed on the image bearing member, in accordance with the detected size of the original.

* * * * *